US005544761A

United States Patent [19]

Zdroik

[11] Patent Number: 5,544,761

[45] Date of Patent: Aug. 13, 1996

[54] SOFT CRANBERRY AND UNDERSIZE CRANBERRY SEPARATOR AND METHOD

[76] Inventor: Jerome J. Zdroik, 7262 10th St., Stevens Point, Wis. 54481

[21] Appl. No.: 328,009

[22] Filed: Oct. 24, 1994

[51] Int. Cl.[6] ..... B07B 13/075

[52] U.S. Cl. ..... 209/672; 209/618

[58] Field of Search ..... 209/617, 618, 209/667, 672, 673, 684

[56] References Cited

U.S. PATENT DOCUMENTS

| | | | |
|---|---|---|---|
| 408,323 | 8/1889 | Prickitt . | |
| 472,299 | 4/1892 | Knapp | 209/618 |
| 578,861 | 3/1897 | Crippen . | |
| 731,828 | 6/1903 | White | 209/599 |
| 738,267 | 9/1903 | Wemp . | |
| 1,079,805 | 11/1913 | Smith | 209/618 |
| 1,339,077 | 5/1920 | Trufant . | |
| 1,700,302 | 1/1929 | Applegate . | |
| 2,966,267 | 12/1960 | Dunbar | 209/672 |
| 2,976,550 | 3/1961 | Silver et al. | 209/672 |
| 5,238,124 | 8/1993 | Cané et al. | 209/672 |

FOREIGN PATENT DOCUMENTS

| | | | |
|---|---|---|---|
| 569018 | 5/1945 | European Pat. Off. | 209/667 |

*Primary Examiner*—William E. Terrell
*Assistant Examiner*—Tamara Kelly
*Attorney, Agent, or Firm*—Joseph M. Recka; Recka & Joannes, S.C.

[57] ABSTRACT

A cranberry separator, and method, to separate soft and undersize cranberries from hard, marketable cranberries. Mushy cranberries do not clog the separator.

Pressure is repeatedly applied to each cranberry, to a pressure less than 0.50 psi, as cranberries are transported from a loading hopper, along a roller conveyor, to an outlet.

The roller conveyor comprises an overhead soft roller, and a finned hard roller, mounted under the soft roller. Each cranberry passes between multiple pinch points, between the upper and lower rollers.

Each cranberry is supported across two fins, at the pinch point. Soft cranberries are forced between the fins, and are stripped out from between the fins, by comb teeth, extending upwardly between the fins. After each pinch point, the cranberry is rotated randomly, to present a new surface to be tested.

10 Claims, 5 Drawing Sheets

SOFT CRANBERRY AND UNDERSIZE CRANBERRY SEPARATOR AND METHOD

BACKGROUND OF THE INVENTION

1. Field of the Invention

The invention is a soft cranberry, and undersize cranberry separator and method; the invention relates to machines for separating hard, marketable cranberries, from soft and undersize cranberries; separation is based on the greater crush resistance of hard, marketable cranberries.

2. Related Art

Prior art cranberry sorting devices, separate soft cranberries from hard cranberries, based on the resilience of cranberries. That is, hard cranberries bounce, soft cranberries do not bounce.

In prior art, cranberries, to be sorted, are dropped onto a hard surface. The hard surface is mounted at an angle to the direction of fall of the cranberries.

Hard marketable cranberries bounce off the hard, angled surface, into a marketable cranberry collector.

Spoiled or bruised cranberries are soft. Spoiled or bruised cranberries, impact the hard angled surface, and slide down the angled surface, into a rejected cranberry collector.

Repeated bouncing of cranberries on angled surfaces, is used to separate marketable cranberries from spoiled cranberries.

The sorting devices that rely on bouncing, to separate cranberries, clog. The surfaces clog because some soft cranberries are so soft, as to be mush. Mushy, soft cranberries stick to the angled surface.

To bounce from the angled surface, hard marketable cranberries have to land on a clean, hard surface.

The bouncing, sorting devices are based on a premise that cranberries are round and will bounce predictably.

Cranberries are not round. When the cranberries bounce, they may not bounce to the sorting area.

If a cranberry has a small soft spot, the cranberry is not marketable. A cranberry may be repeatedly bounced. If the cranberry is not bounced on the soft spot, it will be passed as a marketable cranberry. Hand sorting is necessary to remove cranberries that have passed through the bounce sorter, to sort out cranberries with soft spots.

The invention, a soft cranberry sorter, uses a different concept to separate soft cranberries from hard marketable cranberries.

Cranberries, to be sorted, are loaded into a hopper. From the hopper, the cranberries are fed into a transport conveyor.

The transport conveyor is comprised of two sets of rollers. One set mounted above the other set. The cranberries pass between soft foam upper rollers, and lower finned rollers, from load end to discharge end.

As the cranberries are transported, the cranberries are repeatedly tested to determine if soft spots exist. If a soft spot exists, the cranberry is forced between the fins of transport rollers, and stripped out by a stripper comb.

The cranberry is rolled, while suspended between two fins, of a hard finned transport roller. Force is applied to the cranberry, by a sponge roller, as the cranberry is rolled between two fins.

If any part of the cranberry, rolled between the two fins, while pressure is put on the cranberry, is soft, as soft is defined by the crush resistance of a cranberry, the cranberry will be forced between the fins.

By applying force, by means of a group of soft sponge rollers, the defective cranberry is urged between the fins of a hard transport roller, without the defective cranberry being crushed.

The device is designed to sort defective cranberries without crushing defective cranberries. Crushing the defective cranberries releases cranberry juice, which contaminates the marketable cranberries, and accelerates deterioration of the sorted cranberries.

The number of finned rollers determines the number of times each cranberry is tested, as each cranberry passes over a finned roller.

Applicant's device sorts cranberries, based on crush resistance of marketable cranberries. Laboratory tests were used, to determine the resistance to crushing, of what was defined as a marketable cranberry. Marketable cranberries are more resistent to crushing than are soft, and therefore, non-marketable cranberries.

Applicant's device is specifically designed to overcome the machine clogging property of severely deteriorated mushy cranberries.

Severely deteriorated mushy cranberries, stick to any surface that they touch.

Applicant strips the defective cranberries from the finned transport rollers, by a closely fitted, stationary stripper comb, mounted between adjacent fins. The teeth of the stripper comb extend upwardly into the area between the fins.

A prior art device, using elasticity of cranberries, to separate cranberries is U.S. Pat. No. 1,339,077. That device forced good cranberries into apertures on a roller. The good cranberries were stripped out of the apertures. A problem with a device using apertures to separate out marketable cranberries, is that the apertures clog with the sticky, mushy, severely deteriorated cranberries.

Another approach to sorting cranberries, is the device shown in U.S. Pat. No. 1,700,302. In that device, conveyors transport cranberries up to diagonal barriers. Solid cranberries slide along the conveyor surface. Soft cranberries are crushed, and forced under the diagonal barriers.

SHORT SUMMARY OF THE INVENTION

Cranberries are a natural product. Cranberry bushes are about six inches high. At harvest, cranberry bushes are raked. The raking frees cranberries that are at various stages of ripeness. The raking also releases leaves and other debris.

A soft cranberry separating machine, must be able to operate, with some field debris in the cranberries to be sorted.

Harvesting cranberries is done by flooding the raked bog.

Cranberries, both marketable and non-marketable, float in the flooded bog, together with other debris. The cranberries, with the unwanted products of harvest, are loaded by conveyor, into a bin.

The cranberries are sorted for ripeness, size and color

This invention sorts marketable cranberries, from mushy cranberries and from cranberries that have soft spots.

A cranberry that has a soft spot is defined as not marketable. Sorting of soft cranberries, from marketable cranberries is accomplished by rotating and transporting each cranberry across a plurality of finned support surfaces, while a defined force is applied to each cranberry by a foam roller.

While the cranberry is rotated, while supported between fins, force is applied to the cranberry by a foam roller.

The force is applied to force a soft cranberry into the space between two fins on a slotted roller. The force applied by the foam roller, has been defined by testing, to be below the force that will crush a hard, marketable cranberry.

Two types of rollers are used.

One roller, the top roller, is a soft sponge roller, used to capture a cranberry and then to apply a steadily increasing force to a cranberry, supported by a finned roller.

The second roller is a hard, finned transport-test roller, mounted below the soft sponge roller.

A height adjustable soft sponge roller, captures and applies force to a cranberry, supported between adjacent fins of the transport test roller.

The soft sponge roller, encompasses and surrounds the cranberry being tested. Encompassing and surrounding the cranberry prevents bruising the cranberry, by the force applied by the soft sponge roller.

Undersized cranberries fall out of the machine, between the fins, of the finned transport rollers, to waste containers, mounted below the machine. Field debris, including vines, fall out of the machine, between the fins of the finned transport rollers, to waste containers mounted below the machine.

Soft cranberries are forced between adjacent fins of the transport-test roller.

Very soft cranberries are pushed between the space between the fins. Undersize cranberries fall between the fins of the first transport roller.

Cranberries that have a soft spot, are resilient enough not to be crushed. Those cranberries wedge between the fins.

The cranberries with soft spots, that are wedged between the fins, are stripped out from between the fins, by teeth extending upwardly from a stationary stripping comb, mounted under the finned transport rollers.

The comb teeth, extend upwardly into the area between the fins of the transport rollers.

Marketable cranberries, are transported, by the foam and finned rollers, from one finned roller to the next, from a loading hopper, to the outlet. Sorted, hard cranberries are discharged at the outlet. All of the small cranberries, and the soft and mushy cranberries, are removed prior to the outlet.

DETAILED DESCRIPTION OF THE INVENTION

The soft cranberry separator is designed to separate marketable cranberries 50, and soft cranberries 60, from unsorted cranberries 40.

Figure 1:
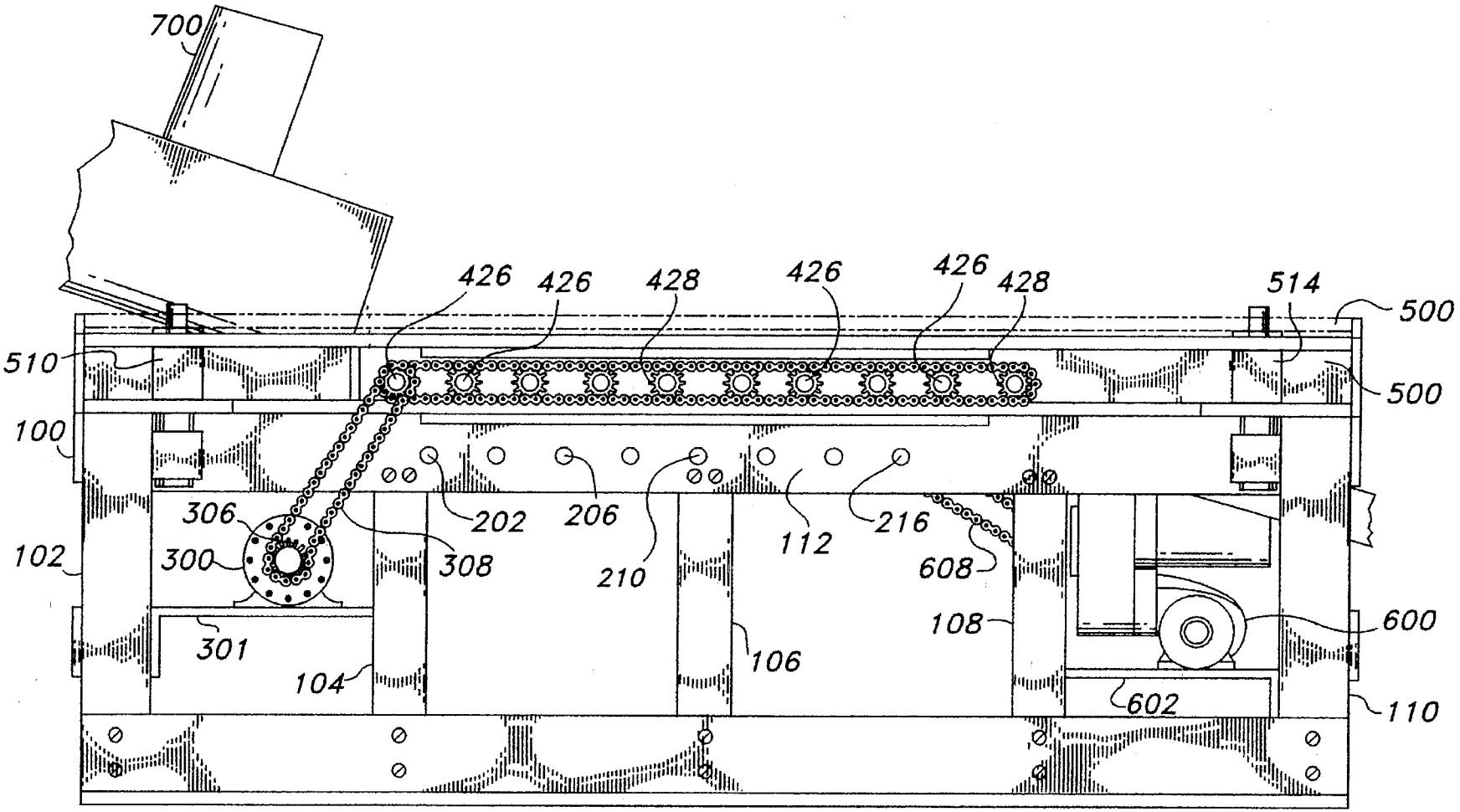
FIG. 1 is a side view of the cranberry separator.

FIG. 1 shows soft cranberry separator 100, a box-like frame, with legs 102, 104, 106, 108 and 110.

As an overview, the hard, finned transport rollers 200, are mounted on stationary platform 112.

Platform 500, is height adjustable. Soft, force applying, sponge rollers 400, are rotatably mounted to height adjustable platform 500.

By varying the height of height adjustable platform 500, above stationary platform 112, the distance between soft, force applying, sponge rollers 400, and finned transport rollers 200, is adjusted. By adjusting the height between the stationary platform, and the height adjustable platform, the distance between rollers 200 and rollers 400, is increased or decreased. Increasing the spacing decreases the force applied to cranberries 40, transported between the rollers. Decreasing the spacing, increases the force applied to cranberries 40.

Figure 5:
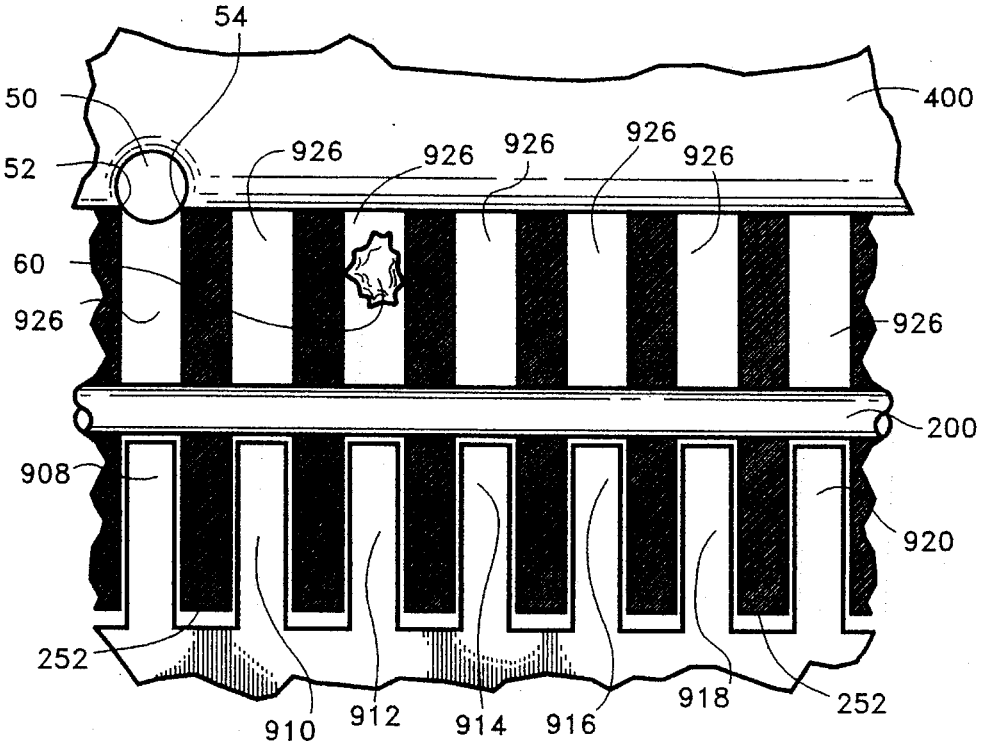
FIG. 5 is a section view, between a hard transport roller, and a sponge, force applying roller.
Figure 6:
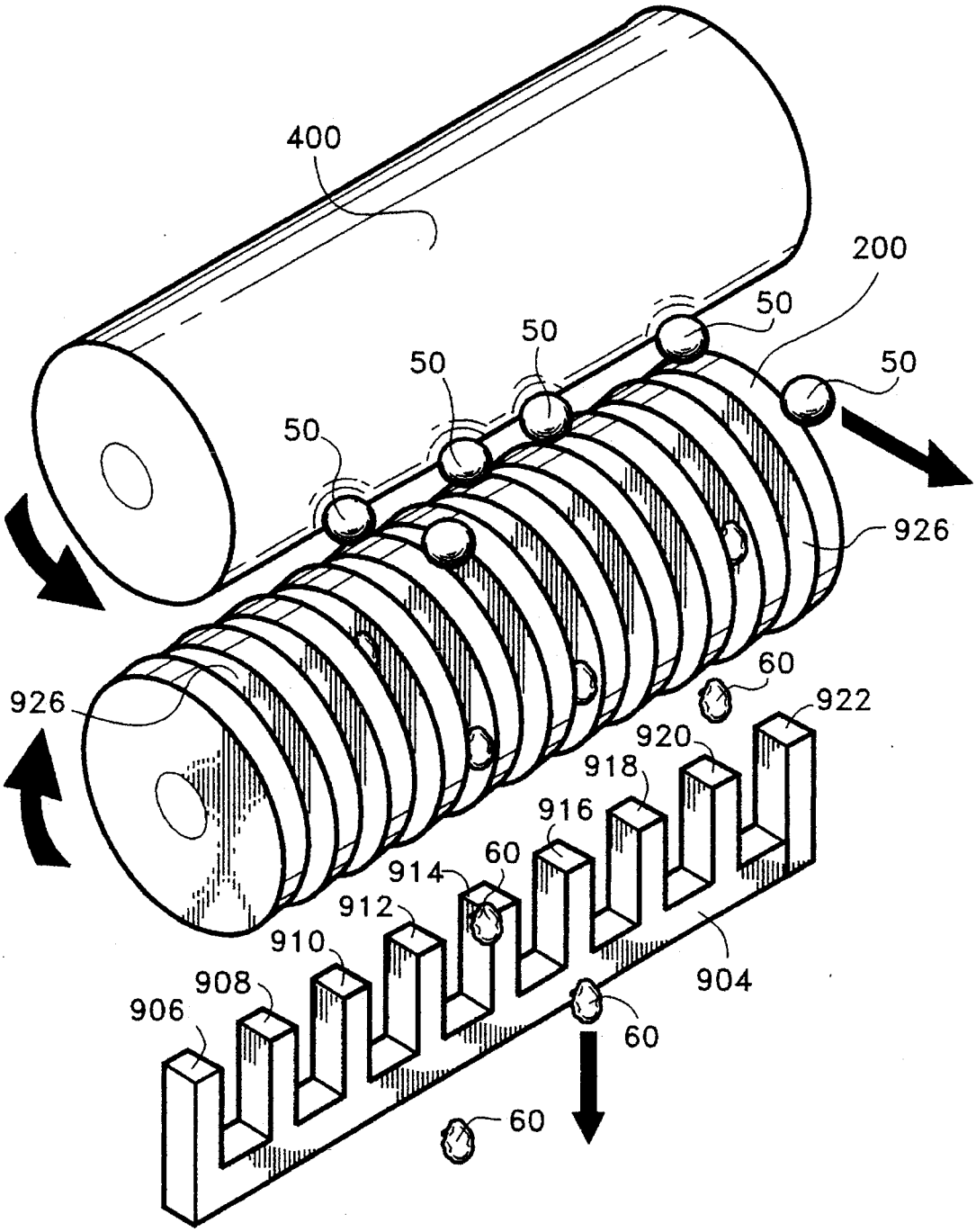
FIG. 6 is a disassembly view of the sponge, force applying roller, the hard finned transport roller, and the stripper comb.

Hard finned transport rollers, in general, are numbered in a 200 series of numbers, as shown in FIG. 5 and FIG. 6.

The extended shafts, of finned transport rollers 202, 206, 210 and 216 can be seen on the side of separator box-like frame 100 in FIG. 1.

Hard finned transport rollers 202 through 216, are mounted to stationary platform 112. The hard finned transport rollers extend across the width 114, of separator box-like frame, 100.

Figure 2:
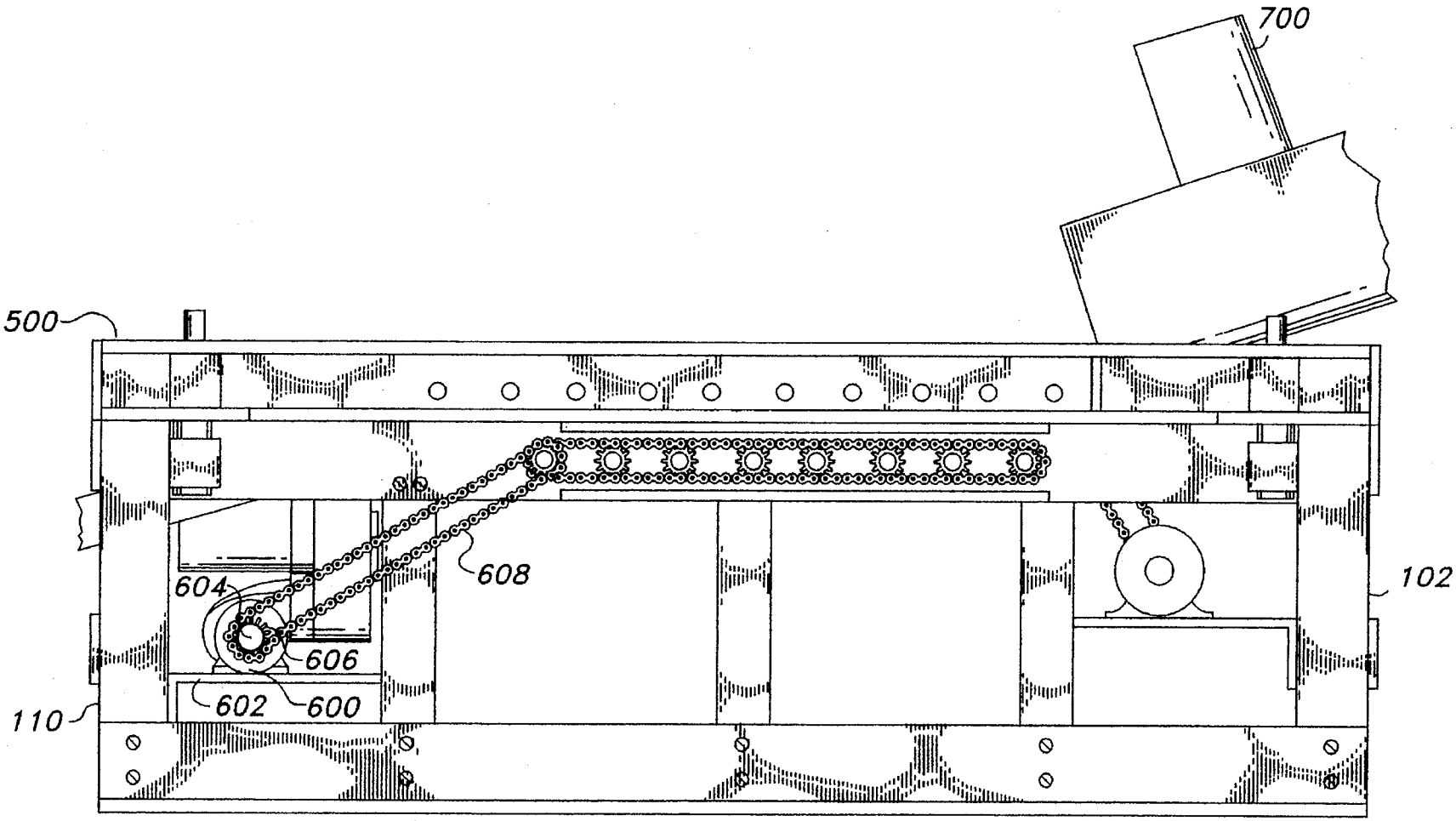
FIG. 2 is a side view of the cranberry separator, from the opposite side of FIG. 1.

Hard finned transport rollers 202 through 216, are mounted in pillow blocks affixed to both sides of separator box-like frame 100. Pillow blocks are old in the art, and are not shown in the drawing. Attached to the hard finned transport rollers 202 through 216, are drive gears. Those gears can best be seen in FIG. 2. FIG. 2 is the opposite side of the separator, from FIG. 1. Some of the gears, affixed to the soft, foam pressure applying rollers, are numbered in FIG. 1.

Below the stationary platform 112, is mounted electric motor 600, shown in FIG. 2. Electric motor 600 is connected at output drive 604, by chain 608, attached to drive sprocket 606. Drive sprocket 606 is connected by chain 608, to the gears mounted on the ends of the series 200 hard finned transport rollers.

As electric power is supplied to electric motor 600, finned transport rollers 200, turn.

Figure 3:
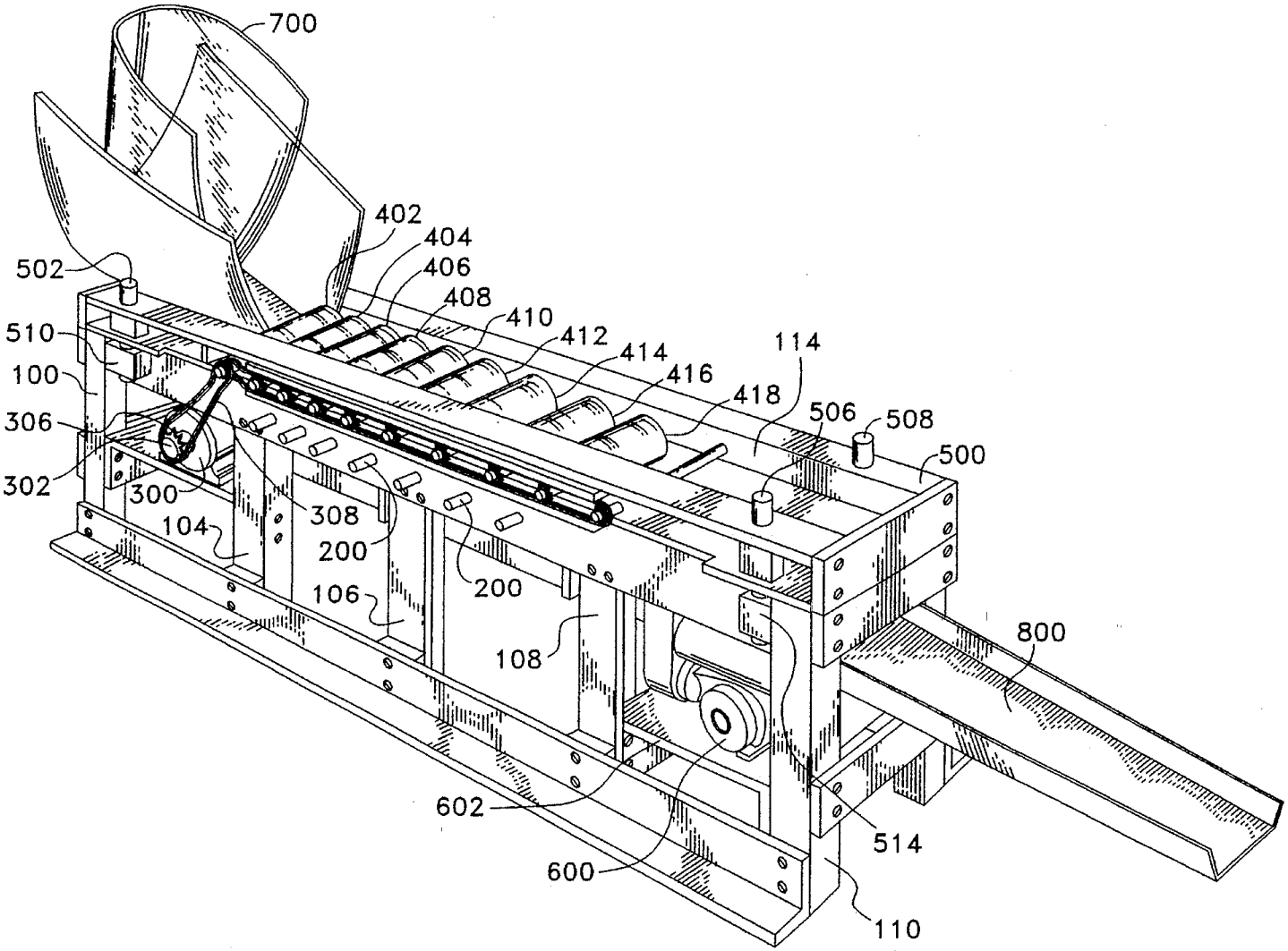
FIG. 3 is a perspective view of the cranberry separator.

Soft force applying rollers 400, are best seen in FIG. 3. Rollers 402 through 418, are mounted to height adjustable platform 500.

Soft force applying rollers 400, are mounted on pillow blocks, affixed to the moveable platform 500.

Attached to the soft force applying roller shafts, are gear support stubs 426. Mounted on gear support stubs 426, are gears 428.

Electric motor 300, is mounted on motor platform 301, attached to separator box-like frame 100.

Extending from the output shaft 302, from output motor 300, is drive sprocket 306. Affixed to drive sprocket 306, is drive chain 308. Motor output shaft 302, is connected to soft force applying roller stubs 426, by gears 428. Motor 300 drives the soft force applying rollers 400, transporting power from the motor 300, to the rollers 400, by drive chain 308.

Moveable platform 500, is mounted on threaded shafts 502, 504, 506, and 508. Adjustment collars 510, 512, 514, and 516 are used to adjust the height of moveable platform 500, above the fixed platform 112.

FIG. 2, an opposite side view from FIG. 1, shows separator box-like frame 100, and the drive to the hard transport rollers. At the right of FIG. 2 can be seen hopper 700.

FIG. 3 is a perspective view. The top cover from the separator, has been removed. Hopper 700, and feed chute 702 are shown on the left.

Cranberries 40, are loaded at feed chute 702.

Moveable platform 500, and stationary frame 112, can be seen in FIG. 3. Cranberries 40, slide by gravity, down from hopper 700, to feed chute 702, up against the first hard finned transport roller 200, and up against soft foam roller 400.

Drive motor 300, drives the soft rollers 400. Drive motor 600 drives the hard rollers 200.

As stated, cranberries 40, loaded at loading hopper 700, slide down chute 702. The cranberries pile up in front of the first hard transport roller. Undersize cranberries, fall out, between the fins, of the first transport roller 200.

Figure 4:
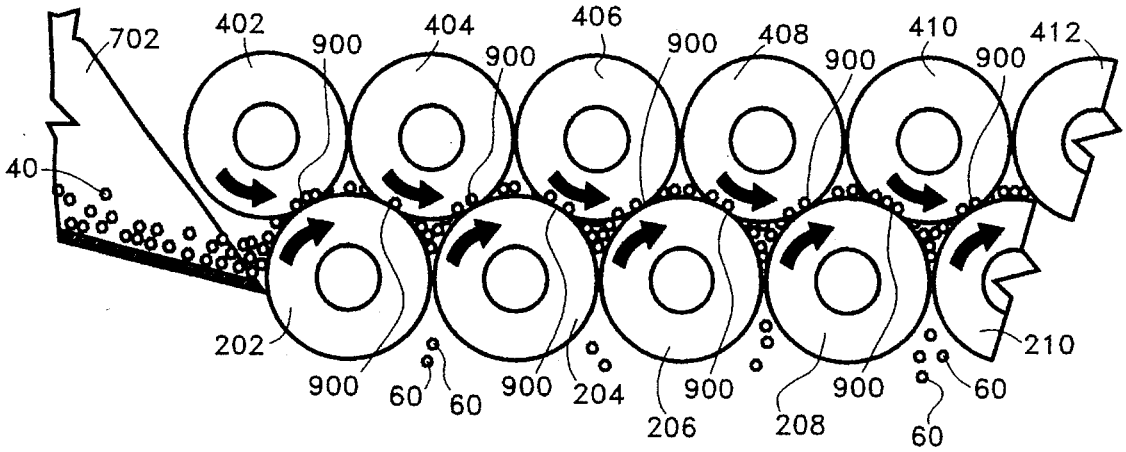
FIG. 4 is a schematic view, showing the transport of cranberries through the sorter, from the inlet, between the hard finned transport rollers, and the sponge, force applying rollers.

As the height of the pile of cranberries, in front of the rollers 200 and 400, builds up, as shown in FIG. 4, the first cranberries are picked up by the pinch point 900. FIG. 4 shows an ordering of rollers 402 through 412, for soft, foam force applying rollers. FIG. 4 shows an ordering of rollers 202 through 210, for hard finned transport rollers.

Cranberries 40, as the pile builds up, are transported from the pinch point 900, formed between rollers 402 and 202, to the pinch point formed between rollers 404 and 202, continuing along the roller, pinch points to the outlet 800.

Cranberries 40, are repeatedly passed from one pinch point 900, to the next pinch point 900.

As the cranberries 40, are passed from one pinch point to the next, over hard finned transport rollers 200, the cranberries 40, are urged into the, between the fins 250.

The cranberries 60, that are soft, and do not resist being forced between the fins 250, are separated from the mass of cranberries 40. Soft cranberries 60 are stripped out of the space, between the fins, by stripper comb 904.

Soft cranberries 60, either fall into the space between fins 926, or are jammed into the space 926 between fins, by the force applied by the soft foam, force applying rollers 400.

Cranberries jammed into the space between the fins, are stripped out of the area between the fins 926, by comb teeth 906 through 922, as shown in FIG. 6.

Cranberries 50, not removed during transport, through the separator, from feed chute 702, exit at chute 800.

FIG. 4 is a schematic view of the transport, of cranberries 40, through the separator.

Cranberries 40 are loaded at loading hopper 700, into feed chute 702.

When the height of the cranberries 40 builds up, at the loading chute 702, to a height where the cranberry can be captured by the soft, force applying roller 402, the cranberry is picked up by the soft, foam force applying roller 402, and fed into the separator.

Each cranberry is squeezed between the sponge roller 402 and the finned transport roller 202.

As each cranberry is transported, from the entrance to the outlet of the separator, the soft, foam, force applying roller, encompasses and surrounds each cranberry.

Force on each cranberry is increased, from a starting force, as the cranberry is moved toward a pinch point 900, to a maximum force at the pinch point. The pinch point is formed between soft roller 402, and hard roller 202. As the cranberry passes beyond the pinch point 900, the pressure, on the cranberry, is released.

The distance between the soft, foam, force applying roller, and the hard, finned, transport rollers, can be varied from the entrance end of the separator, to the output chute 800.

Very little force is needed at rollers 402 and 202, to separate the great mass of soft berries from the field harvest.

At the output end, such as at rollers 210, and 412, more force can be applied to the cranberries, to separate out cranberries that have small soft spots.

Each pressure tested cranberry, either passes into the space between the fins 252 is wedged between the fins 252, or successfully passes through, to the space between hard roller 202, soft roller 402, and soft roller 404. In this space, the tested cranberries are randomly rotated before passing to the next pressure test.

Each tested cranberry, for example, having been tested at the pinch point, between roller 202 and roller 402, randomly rotates in the open area between roller 402 and 404. In FIG. 4, nine randomly rotating spaces, are shown.

FIG. 4 shows nine, and part of a tenth, pinch point 900. At each of those pinch points 900, the cranberry to be tested is subject to pressure, to a maximum, urging the cranberry, between adjacent fins.

Each pinch point separates out cranberries. Each randomly rotating area orients the cranberry, in a different direction, so a different surface of a cranberry will be tested at the next pinch point 900.

At the bottom of FIG. 4, defective cranberries 60 can be seen falling out, or being stripped out, as the cranberries are transported from the loading hopper 700 to the outlet 800.

A substantial percentage of soft cranberries 60 are removed at first sponge roller 402, and first hard finned transport roller 202.

These cranberries are the severely deteriorated cranberries that clog other machines.

FIG. 5 is a section view, between a hard transport roller 200, and a sponge, force applying roller 400.

FIG. 5 shows force applying roller 400, at a section through a pinch point 900.

This section shows stripper comb teeth 908, 910, 912, 914, 916, 918 and 920. Stripper comb teeth 908 through 920 are closely fitted within the area between fins 926. The stripper teeth 908 through 920, strip out the soft, sticky, deteriorated cranberries 60.

The stripper teeth also strip out those cranberries wedged into area 926. The stripped cranberries fall out the bottom of the machine.

The pinch point 900, is the contact area between the soft sponge roller 400, and the hard finned transport roller 200.

At, and immediately before the pinch point, increasing force is applied to each cranberry. The force applied increases from 0.0 pounds per square inch, to 0.15 pounds per square inch, as each cranberry is passed between sponge roller 400, and hard finned transport roller 200.

Each cranberry repeatedly goes through pinch points 900.

As cranberries 40 are transported between pinch points 900, the cranberries are randomly rotated in area 902, to present a new testing surface at the next pinch point.

FIG. 5 is a section view. FIG. 5 shows a hard finned transport roller 200. In operation, a few hard cranberries 50, ride on the perimeter of the fins 252.

The width of the fins 252, is 3/16 of an inch. The cranberries to be sorted are at least 13/32 in diameter.

The cranberries being sorted are so much wider than the width of the fins, the cranberries, when picked up by the sponge roller, tend to be forced towards the area between fins 926, rather than held on the width of the fins 252.

FIG. 6 is a disassembly view of the stripper, sorter assembly. Soft sponge roller 400, hard transport roller 200, and a comb 904, with teeth 906 through 922 are shown.

This disassembly view shows the essence of the invention. Counter rotating rollers 200 and 400, transport the cranberries 50.

Direction of rotation of the rollers 200 and 400, is shown by black arrows. Direction of travel of cranberries 50, is shown by a black arrow.

Comb 906, has been lowered in this disassembly view, out of engagement between the fins of roller 200. A black arrow at the bottom of the drawing shows the direction of movement of the comb 906, out of its normal engagement within roller 200.

Comb teeth 906 through 922, in operation, extend upwardly into the area 926 between fins 250.

The soft foam roller 400 is shown, encompassing cranberry 50. The hard cranberry 50 is supported at two points 52 and 54, best shown in FIG. 5, on the perimeter of the hard cranberry 50, and the adjacent fins 250.

A soft cranberry 60, is shown in FIG. 6, being urged between fins 250, along hard finned roller 200.

Comb 904, with its upwardly extending comb teeth 906 through 922, strips the defective cranberries out of the area 926, between the fins 250, causing the soft cranberries 60, to fall into a trash container mounted below the device.

BEST METHOD

An object of the invention is to provide a dry sorter. The separation of cranberries by liquid transport, was considered. However, wetting a cranberry after harvest, greatly increases the rate of deterioration of the cranberry.

The sorting device was required to be one that generated little fluid from crushed cranberries. The cranberry juice from crushed cranberries accelerates the deterioration of the hard cranberries.

A problem, not addressed by other sorting devices, is that some cranberries, are so soft they stick and cling to every surface they touch. The sticking soft cranberries, clog machines. The sticking cranberries do not clog Applicant's machine.

To design the sorting machine, a definition of a marketable cranberry and a soft, non-marketable cranberry was needed.

It is obvious, that a cranberry so soft, as to stick to every surface it touches, is not marketable. It is less obvious that a cranberry, that may be soft only on five percent of its surface area, may also be not marketable.

This device repeatedly tests different surfaces of each cranberry, to determine if any surface, on the cranberry, has a crush strength, less than what is defined to be the crush strength of a marketable cranberry.

The pressure applied to each cranberry, is a uniformly increasing pressure, applied to a cranberry, while the cranberry is rolled across two support surfaces. The pressure is increased to a defined maximum, decreasing uniformly after the maximum. Each cranberry is then randomly rotated to provide a new surface to be tested. Then that surface is also tested. Testing continues, to what can be a mathematically defined level of separation.

The testing to define a good marketable cranberry was as follows:

A cranberry was placed between the fins of the sorter. A lever, with a cupped end, designed to distribute the force over the upper half of the cranberry, was placed over the cranberry.

Weights were suspended from the lever to apply increasing force on the cranberry. Marketable cranberries were tested, in volume, in order to determine the force needed to damage a marketable cranberry.

The average force, and the statistical spread of multiple trials, determined that the maximum force that may be applied without causing damage to a marketable cranberry, is 1.2N or 0.3 pounds-force.

This force corresponds to a maximum pressure of 3000 Pa or 0.5 psi.

Spoiled cranberries were tested to determine the minimum force necessary to cause a spoiled cranberry to lodge between the fins of the sorter.

The average force, and the statistical spread of multiple trials determined that a minimum force of 0.5 N or 0.1 pounds-force is required to wedge spoiled cranberries between the fins. The force corresponds to a minimum pressure of 1000 Pa or 0.15 psi.

The soft cranberry sorting machine can be adjusted to apply the force desired. In operation, the best method is to determine that spacing between the sponge roller, and the hard transport roller, that will apply 0.3 psi to cranberries to be sorted.

At 0.3 psi, marketable cranberries will not be injured, and defective cranberries will be forced between, or wedged between the fins of the sorter, and stripped out by the comb teeth.

An operator of this machine would run a test with the cranberries to be sorted. The test would be to determine what amount of force to apply to the particular run of cranberries that the operator is sorting.

The operator would observe the cranberries being sorted in the test.

If the sorter, in rolling the cranberry across the finned transport roller, by the sponge roller, clearly marked the cranberry, the sponge roller would be raised, to lower the amount of force applied to the cranberries. The spacing between the sponge roller and the finned transport roller, determines the amount of force applied to each cranberry.

The spacing between the sponge roller, and the finned transport roller, is determined by the operator. The size of the cranberries being sorted, and the condition of the cranberries will determine what spacing there should be between the sponge roller, and the finned transport roller.

For example, the late season cranberries are softer. Late season cranberries that are sorted on the machine on a Monday, if resorted the next day, at the same force, the machine will separate out cranberries that have deteriorated over 24 hours. Sorting late season cranberries requires a wider spacing, and therefore a lower pressure at the pinch point, between the sponge rollers, and the finned transport rollers.

The distance between each fin is 13/32 of an inch in the best method.

Cranberries with a diameter less than 13/32 of an inch, fall out between the fins of the transport rollers.

Any cranberry with a diameter less than 13/32 of an inch, is not marketable as a individual cranberry. Small cranberries, that is cranberries with a diameter of less than 13/32 of an inch, are used to produce juice.

The space between each finned roller, is 1/16 of an inch. That is, the distance between each roller as they are mounted. FIG. 4 shows rollers 202 through 210. The distance between the perimeter of roller 202 and the perimeter of the next roller, 204, is, at the closest point, 1/16 of an inch.

In the best method, a sponge roller made of high density, hydrophilic polymer foam, is used to apply pressure to the cranberry.

The finned rollers are made of UHMW plastic.

In the best method, there are more upper sponge rollers than there are lower finned rollers. The upper sponge rollers are staggered as shown in FIG. 4.

In the area between each foam roller, and in the area between each finned roller, a tested cranberry is randomly rotated. The randomly rotated cranberry, is picked up by the subsequent pinch point, by a foam roller, and forced across the support surface, which is the perimeter of two parallel adjacent fins, by the next sponge roller.

The random orientation of the cranberry, caused by its rotation, in the area, between the rollers, assures that an untested surface will pass between the pinch point, and across the next finned transport roller.

The mushy and soft field harvested cranberries are removed at the first two or three finned transport rollers. Those finned transport rollers, and the sponge rollers, above them, are quickly stained by mushy cranberries.

The first three rollers, may be separately adjusted, in the best method, to put less pressure on the cranberries, because of the large number of soft cranberries removed at the first three stations. Less pressure, at the first three sponge rollers, minimizes the amount of juice produced in sorting.

After the first three rollers, the subsequent rollers sort to remove slightly damaged cranberries, those that have soft spots.

The cranberries that get wedged into the space between fins on the finned transport rollers, are the cranberries that have soft spots.

The finned transport test rollers, are mounted below the sponge rollers. The sponge rollers, of a chosen durometer, apply force to the cranberries as they are transported between the upper and lower rollers.

The cranberries that successfully pass testing, and are transported through the separator, are firm and marketable cranberries. The number of transport rollers, and the associated foam rollers, in any machine, can be determined by the machine designer. Mathematically, it can be determined how many tests are appropriate to obtain the desired separation of cranberries with soft spots, from cranberries without. The best method uses twelve finned rollers, and thirteen soft foam rollers.

An alternate method, using a continuous foam belt, to apply pressure, a larger number of foam rollers, arranged in an arc, around the finned transport rollers, three foam rollers to each hard transport rollers, to apply pressure, were tested. In the best method, the least complicated mechanical method, to apply pressure to the cranberries, is the design shown.

I claim:

1. A cranberry separator, used for separating out undersize and soft cranberries, from hard marketable cranberries, comprising:

a. a frame;

b. a cranberry loading hopper, affixed to said frame;

c. a cranberry feed chute, extending from said loading hopper;

d. a plurality of finned, rollers, rotatably mounted, perimeter to perimeter, to said frame, the first of said rollers mounted adjacent to said feed chute;

e. a plurality of combs;

f. a plurality of comb teeth, extending from said combs, extending between the fins, of said finned rollers;

g. a plurality of sponge rollers, rotatably mounted, perimeter to perimeter, to said frame, said sponge rollers mounted adjustably above, and adjacent to, said finned rollers;

h. a plurality of pinch points, formed by the perimeter of said finned rollers, and the perimeter of said sponge rollers; the first pinch point, located adjacent to said feed chute;

i. means to drive rollers;

j. a cranberry outlet;

k. a last pinch point, adjacent to said cranberry outlet;

wherein hard cranberries, fed from the loading chute, at the first pinch point, upon engagement of the roller drive means, are fed into said first pinch point, forced against said first hard finned roller, transported, pinch point to pinch point, from the cranberry inlet chute, to the cranberry outlet.

2. The device in claim 1, wherein the width between the fins on the finned rollers, is greater than the width of undersize cranberries, wherein undersize cranberries fall out of the machine, between the fins.

3. The device in claim 1, wherein the spacing between the finned rollers, and the sponge rollers, is adjustable, at each pinch point, to vary the pressure placed on each cranberry, at each pinch point.

4. A cranberry separator, used for separating out undersize and soft cranberries, from hard marketable cranberries, comprising:

a. a box-like frame;

b. a stationary platform, affixed to said box-like frame;

c. a plurality of hard, finned transport rollers, rotatably mounted, from one end to the other of said box-like frame;

said hard finned transport rollers, extending across the width of said box-like frame;

the direction of the axis of rotation of said rotatably mounted finned transport rollers, being from one end to the other, of said box-like frame;

the spacing between the fins of the finned transport rollers, being greater than the width of an undersize cranberry;

d. a plurality of combs, mounted below said finned transport rollers;

e. comb teeth, extending upward from each of said combs, said comb teeth extending into the space between the fins of said finned transport rollers, operable to strip out any material caught between the fins;

f. means to rotate the hard, finned transport rollers;

g. a height adjustable platform, mounted to said box-like frame;

h. a plurality of sponge rollers, rotatably mounted to said height adjustable platform;

said sponge rollers extending across the width of the box-like frame;

the direction of the axis of rotation of said rotatably mounted sponge rollers, being from one end to the other, of said box-like frame;

i. a plurality of pinch points formed between said soft sponge rollers, and said hard finned rollers;

j. means to adjust the height of the height adjustable platform, to vary the spacing between said soft sponge rollers, and said hard finned rollers, at said pinch points;

k. means to rotate the sponge rollers;

l. a loading hopper affixed to one end of said box-like frame;

m. a feed chute extending outwardly from said loading hopper;

n. an outlet, affixed to the opposite end of said box-like frame;

wherein cranberries loaded into said loading hopper, upon energizing the means to rotate said rollers, are transported from one end of said box-like frame, to the other end of said box-like from loading chute to outlet.

5. A cranberry separator, used for separating out undersize and soft cranberries, from hard marketable cranberries, comprising:

a. a box-like frame;

b. a stationary platform, affixed to said box-like frame;

c. a plurality of hard, finned transport rollers, rotatably mounted, from one end to the other of said box-like frame;

said hard finned transport rollers, extending across the width of said box-like frame;

the direction of the axis of rotation of said rotatably mounted finned transport rollers, being from one end to the other, of said box-like frame;

the spacing between the fins of the finned transport rollers, being greater than the width of an undersize cranberry;

d. a plurality of combs, mounted below said finned transport rollers;

e. comb teeth, extending upward from each of said combs, said comb teeth extending into the space between the fins of said finned transport rollers, operable to strip out any material caught between the fins;

f. means to rotate the hard, finned transport rollers;

g. a height adjustable platform, mounted to said box-like frame;

h. a plurality of sponge rollers, rotatably mounted to said height adjustable platform;

said sponge rollers extending across the width of the box-like frame;

the direction of the axis of rotation of said rotatably mounted sponge rollers, being from one end to the other, of said box-like frame;

i. a plurality of pinch points formed between said soft sponge rollers, and said hard finned rollers;

j. means to adjust the height of the height adjustable platform, to vary the spacing between said soft sponge rollers, and each of said hard finned rollers, at each pinch point;

k. means to rotate the sponge rollers;

l. a loading hopper affixed to one end of said box-like frame;

m. a feed chute extending outwardly from said loading hopper;

n. an outlet, affixed to the opposite end of said box-like frame;

wherein cranberries loaded into said loading hopper, upon energizing the means to rotate said rollers, are transported from one end of said box-like frame, to the other end of said box-like from loading chute to outlet, intermittently being forced against said hard transport rollers, at each pinch point.

6. Method for separating, soft, crushed, and undersize cranberries, from hard, marketable cranberries, comprising the steps of:

a. loading unsorted cranberries;

b. removing undersize cranberries;

c. transporting the remaining cranberries, from a loading hopper, to a discharge outlet through a plurality of pinch points;

d. applying pressure, to each cranberry, while the cranberries are being transported, from said loading hopper, to said discharge outlet at each pinch point; said pressure being applied between a soft roller and a hard roller with combs with a minimum pressure of 0.15 psi and a maximum pressure of 0.5 psi, a pressure that will crush a soft cranberry, and be born by a hard cranberry;

e. removing crushed cranberries; and f. discharging the uncrushed cranberries at the discharge outlet.

7. Method for separating, soft, crushed and undersize cranberries, from hard, marketable cranberries, comprising the steps of:

a. loading unsorted cranberries;

b. removing undersize cranberries;

c. transporting the remaining cranberries, from a loading hopper, to a discharge outlet through a plurality of pinch points;

d. intermittently applying pressure, to each cranberry, while the cranberry is being transported from said loading hopper, to said discharge outlet at each pinch point; said pressure being applied between a soft roller an a hard roller with combs with a minimum pressure of 0.15 psi and a maximum pressure of 0.5 psi, a pressure that will crush a soft cranberry, and be born by a hard cranberry;

e. removing crushed cranberries, after each application of pressure; and f. discharging the uncrushed cranberries at the discharge outlet.

8. Method for separating, soft, crushed and undersize cranberries, from hard, marketable cranberries, comprising the steps of:

a. loading unsorted cranberries;

b. removing undersize cranberries;

c. transporting the remaining cranberries, from a loading hopper, to a discharge outlet through a plurality of pinch points;

d. intermittently applying pressure, to each cranberry, while the cranberry is being transported from said loading hopper, to said discharge outlet at each pinch point; said pressure being applied between a minimum pressure of 0.15 psi and a maximum pressure of 0.5 psi, a pressure that will crush a soft cranberry, and be born by a hard cranberry;

e. removing crushed cranberries after each application of pressure;

f. randomly rotating each cranberry, after each application of pressure, so a new surface of each cranberry, is put under pressure, at each intermittent application of pressure; and g. discharging the uncrushed cranberries at the discharge outlet.

9. Method for separating soft, crushed and undersize cranberries from hard, marketable cranberries, comprising the steps of:

a. taking a random sample of the cranberries to be sorted;

b. testing the random sample, of cranberries to be sorted, to establish the crush strength of the cranberries, in the random sample;

c. loading unsorted cranberries;

d. removing undersize cranberries;

e. transporting the remaining cranberries from a loading hopper to a discharge outlet through a plurality of pinch points;

f. applying pressure at each pinch point, to each cranberry, at a force greater than the crush strength of a soft cranberry, less than the crush strength of a hard, marketable cranberry, as established by the testing in step b;

g. removing crushed cranberries;

h. randomly rotating the cranberry after each application of pressure;

i. calculating the number of times pressure must be applied to each cranberry at each pinch point, to obtain the desired percentage of marketable cranberries, discharged at the discharge outlet; and j. repeating the intermittent application of pressure at each pinch point, and rotation, from the loading hopper to the outlet, the number of times determined by step i.

10. The claim of claim 9, wherein the method for separating soft, crushed and undersize cranberries from hard, marketable cranberries, comprising the steps of:

a. taking a random sample of the cranberries to be sorted;

b. testing the random sample, of cranberries to be sorted, to establish the crush strength of the cranberries, in the random sample; wherein the pressure applied to each cranberry is greater than 0.15 psi and less than 0.50 psi;

c. loading unsorted cranberries;

d. removing undersize cranberries;

e. transporting the remaining cranberries from a loading hopper to a discharge outlet through a plurality of pinch points;

f. applying pressure at each pinch point, to each cranberry, at a force greater than the crush strength of a soft cranberry, less than the crush strength of a hard, marketable cranberry, as established by the testing in step b;

g. removing crushed cranberries;

h. randomly rotating the cranberry after each application of pressure;

i. calculating the number of times pressure must be applied to each cranberry at each pinch point, to obtain the desired percentage of marketable cranberries, discharged at the discharge outlet; and j. repeating the intermittent application of pressure at each pinch point, and rotation, from the loading hopper to the outlet, the number of times determined by step i.

* * * * *